US005394064A

United States Patent [19]

Ranganath et al.

[11] Patent Number: 5,394,064

[45] Date of Patent: Feb. 28, 1995

[54] ELECTRONIC BALLAST CIRCUIT FOR FLUORESCENT LAMPS

[75] Inventors: Krishnappa Ranganath; Alexander Kurnia, both of Milwaukee, Wis.

[73] Assignee: Micro-Technology Inc.-Wisconsin, Menomonee Falls, Wis.

[21] Appl. No.: 136,705

[22] Filed: Oct. 15, 1993

[51] Int. Cl.[6] ..... H05B 37/02

[52] U.S. Cl. ..... 315/209 R; 315/206; 315/291; 315/DIG. 2; 315/DIG. 7

[58] Field of Search ..... 315/206, 210, 219, 224, 315/244, 291, 209 R, 278, 294, 324, DIG. 2, DIG. 7, 106, 107

[56] References Cited

U.S. PATENT DOCUMENTS

| | | | |
|---|---|---|---|
| 4,251,752 | 2/1981 | Stolz | 315/206 |
| 4,277,728 | 7/1981 | Stevens | 315/DIG. 7 X |
| 5,055,746 | 10/1991 | Hu et al. | 316/106 X |

*Primary Examiner*—Robert J. Pascal
*Assistant Examiner*—Haissa Philogene
*Attorney, Agent, or Firm*—Robert J. Black

[57] ABSTRACT

An electronic ballast circuit for multiple fluorescent lamps. Control is achieved by varying the voltage and the frequency of operation of an inverter utilized to drive the fluorescent lamps. A separate voltage boost converter provides regulated voltage to the converter. Dimming is accomplished by varying the voltage either manually or in response to sensor circuitry.

11 Claims, 3 Drawing Sheets

ELECTRONIC BALLAST CIRCUIT FOR FLUORESCENT LAMPS

BACKGROUND OF THE INVENTION

1. Field of the Invention

The present invention relates to fluorescent lamps, and more particularly to an electronic ballast circuit which includes means to regulate load voltage by varying or pre-programming the input voltage and frequency to power fluorescent lamps.

2. Background Art

A background art search directed to the subject matter of this application and conducted in the United States Patent and Trademark Office disclosed the following U.S. Pat. Nos.: 4,071,812 4,926,097 5,049,788 4,730,242 4,935,857 5,055,746 4,851,739 4,999,546 5,144,205 4,860,184 5,043,680 5,191,263 4,920,302

None of the patents uncovered in the search discloses means for varying the input voltage or frequency, or a combination of both, to regulate the output load voltage dynamically to achieve a dimming operation of lamps, or in the alternative to have a regulated steady state load and no load voltage by programming the frequency and input voltage in the load resonant circuitry.

Virtually all of the circuits provided in the background art seem to be of the single ended type, providing circuitry used with a single or a known load.

SUMMARY OF THE INVENTION

Fluorescent lamps are ideal loads for load resonant circuits inasmuch as such lamps have a very high impedance when they are not ignited and offer substantially less resistance when they are on. If a load such as this is connected as a damping element in a series resonant inverter, the circuit will give substantial starting voltage and once the lamp is on, the low resistance of the lamp dampens the resonance determining the voltage across the lamp.

To effectively utilize this phenomena, frequency of operation, as well as the magnitude of the DC input voltage must be determined. In the present invention, a preconverter establishes the necessary DC voltage to the inverter and the inverter then drives a multiple set of resonant inductors and capacitors. In the absence of load on the resonant circuit, operation of the inverter is determined by the switching frequency which is set to be in the lower region of natural resonance. This is essential to limit the circulation current in the inductor and capacitor, which becomes much more substantial if operated near or above the area of resonance. An analytical solution obtained for this region shows the safe operating areas. It has been determined that during a no load condition, by limiting device loss to a minimum value, the control circuitry operates in a so-called "hiccup" mode. In this mode, the inverter is made to operate in small intervals to establish thermal stability.

By varying the input DC voltage, or frequency of switching, or a combination of both, it is possible to establish the steady state operating voltage for the circuitry. In the alternative, dimmer circuitry which recognizes external settings can change the frequency and voltage to operate in a variable power mode thus controlling the intensity and brightness of the lamp.

It has been found very desirable to design inverters for fluorescent lamps to utilize resonant circuits which give essentially high starting voltage and good load regulation. As indicated in the present invention the concept is to regulate the load voltage by varying or pre-programming the input voltage and frequency to power fluorescent lamps. In the present arrangement, a preregulator converts AC into DC. The value of this direct current can be varied or programmed to a particular value. Subsequently, the DC bus is connected to a half bridge push-pull driver which drives four independent resonant circuits each comprising an inductor and a capacitor. Feedback from the resonant inductors connected to the control circuit determines load or no load type of operation.

By varying the input voltage or frequency, or combination of both, the circuit can regulate the output load voltage dynamically to achieve dimming operation of the lamps, or in the alternative to provide a regulated steady state and no load voltage by programming the frequency and input voltage of the load resonant circuitry. A subsequent additional dimming interface provides accurate control of lighting.

Accordingly, it is the object of the present invention to produce a circuit which can deliver variable power or constant power to fluorescent lamps by adjusting frequency and voltage or deliver steady state voltage by programming the frequency and input DC voltage. Yet another objective is to define proper dimming logic and to produce a circuit with minimum switching loss in both loaded and unloaded conditions.

DETAILED DESCRIPTION OF THE PREFERRED EMBODIMENT

Figure 1:
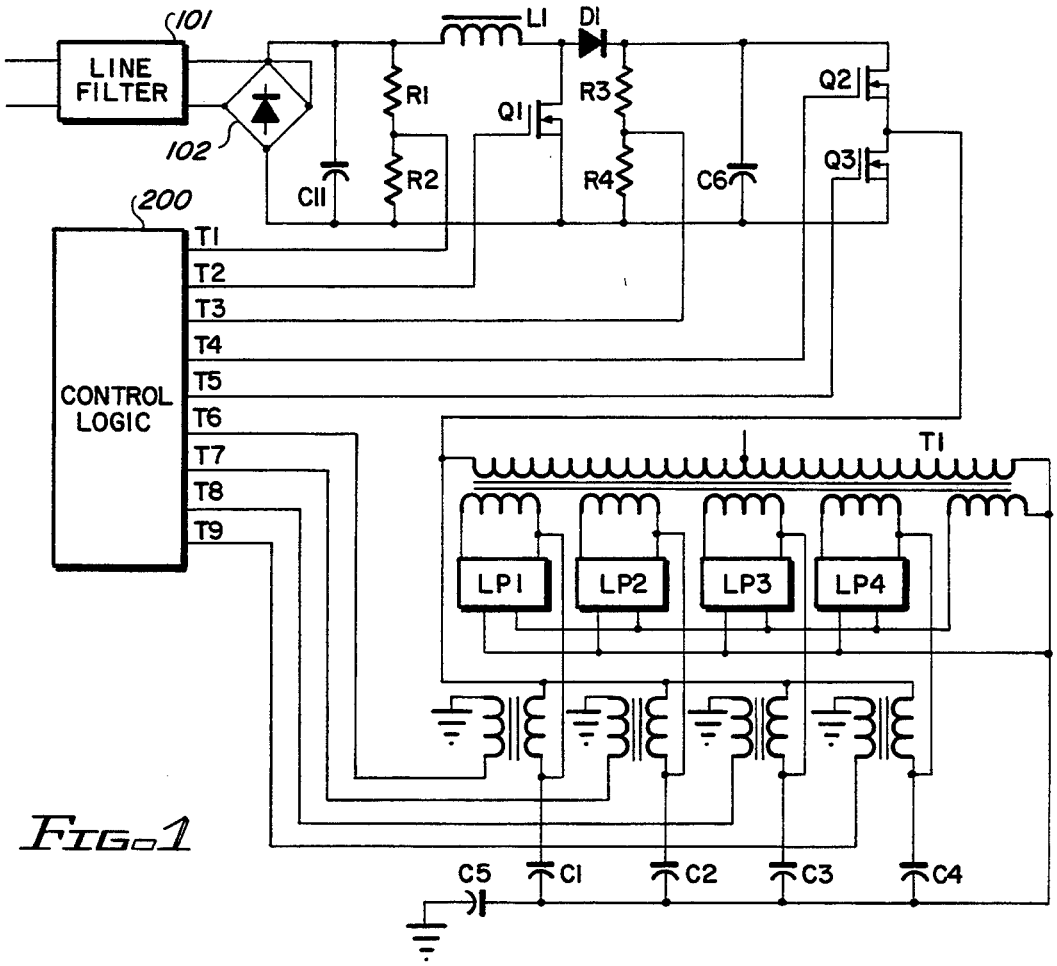
FIG. 1 is a circuit diagram of a fluorescent lamp electronic ballast in accordance with the present invention.

Referring now to FIG. 1, the circuit diagram for the proposed design is shown. Input from the alternating current line is filtered through a simple line filter 101. This line filter typically consists of a common mode transformer and a capacitor connected between line and neutral. It may also include a pair of "Y" capacitors to filter RF signals conducted from the ballast to ground. The principal function of the line filter is to filter any switching noise from inverter to the power line. Specific details of the line filter do not form a portion of the present invention. The filtered alternating current is then rectified by bridge rectifier 102. The inclusion of a varistor or tranzorb connected between line and neutral or ground would help to overcome any transient voltage appearing on the line.

The DC output from bridge rectifier 102 is connected to a single switch boost converter employing single transistor Q1. This then provides a regulated voltage to the inverter section which includes transistors Q2 and Q3. The output voltage from the boost converter can be programmed to a specific value either by setting the resistor network, consisting of resistors R3 and R4, or dynamically changed by varying the error amplifier input in the control unit. Feedback resistors R1 and R2 help the controller 200 to achieve a high power factor by maintaining line current in coherence with the line voltage. The power factor and DC boost converter circuitry is of the variable frequency fixed on-time or fixed frequency type of conventional design.

The push-pull drive circuitry to generate a square wave is provided by transistors Q2 and Q3 with the frequency of generated square wave being determined by the controller 200.

Figure 2:
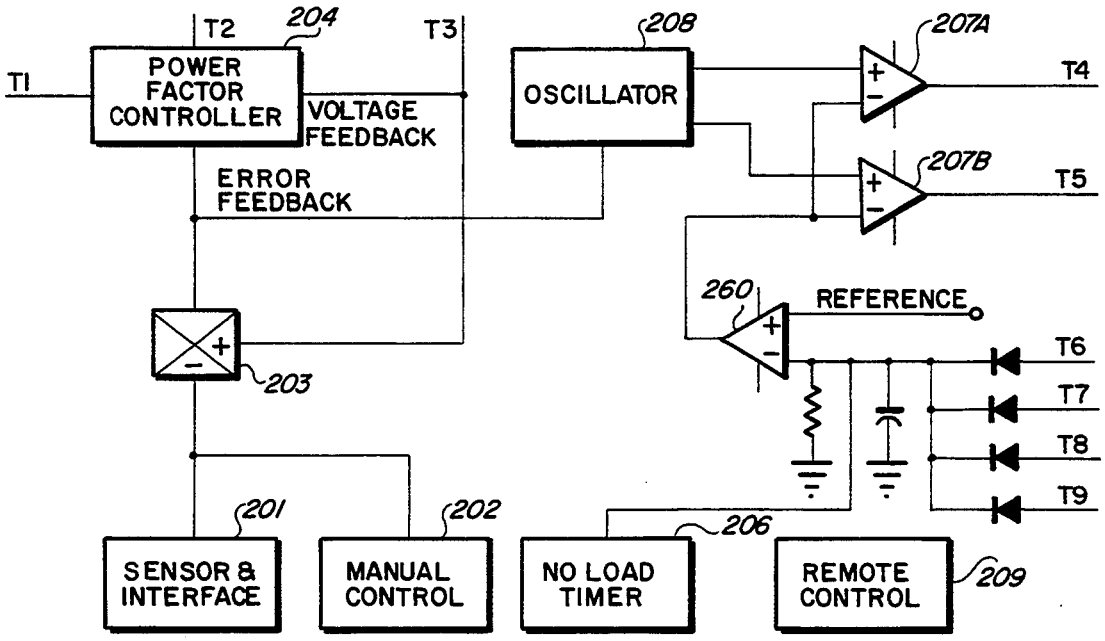
FIG. 2 is a block diagram of control circuitry utilized in connection with the operation of the above-described ballast.

Referring now to FIG. 2, the control circuitry is shown essentially in block diagram form. Details of the individual blocks as shown do not form a portion of the invention inasmuch as they are well known in the field, it only being required that they perform the functions as described herein.

The power factor controller 204 is a commercial circuit employing on-time variable frequency boost, or a flyback or fixed frequency type converter. DC voltage feedback from the input of the inverter is compared with information from the error amplifier 260 feedback to regulate the programmed DC output voltage.

Programmable oscillator 208 provides a square wave output with a dead time to drive the transistors Q2 and Q3 of the inverter circuitry. Drive is provided by drivers 207A and 207B, respectively, to transistors Q2 and Q3, respectively. The introduction of dead time between transistor switching helps to reduce switching losses. The transistors, as indicated, are driven by high current drivers 207A and 207B which can be disabled by an external signal. This is accomplished in order to reduce excessive switching losses during no-load operation by utilizing a free running oscillator 206 to provide a beat frequency in slow intervals. This frequency is validated by feedback from lamp circuits applied to driver 206. It is found that lamp feedback gives an average DC of the inductor voltage on all four inductors L2, L3, L4 and L5. To achieve this, each of the resonant inductors L2, L3, L4 and L5 is tapped and rectified utilizing switching diodes D261, D262, D263 and D264, respectively, and filtered with capacitor 265. If during operation the circuit does not have a load, then the peak sample voltage will be smaller than the reference set on the feedback comparator. This will not disable the transistor drivers. The beat oscillator 208 generates signals sufficiently larger than the reference to turn on the inverter in short intervals to accommodate start up. Alternatively, if there is a load on, then the inductor current will have peak voltage which is above the reference level set on the feedback comparator. This enables the output drivers to run continuously. This mode of operation can be generally termed a "hiccup mode" of inverter operation.

To control the power delivered to the lamps feedback network 203 is utilized. This network takes input from the dimming logic and the input DC voltage and will give proper control to vary the DC voltage of the preconverter and frequency of the oscillator.

The dimming logic 201 gives a compatible voltage to interface typical circuitry available commercially to provide manual control logic to vary the lamp intensity by adjusting an included resistor, or in the alternative additional control may be established by a combination of a photo sensor and directional sensor and a digital interface. An external remote control 209 (which is radio frequency or infra red) sends signals to the directional sensor. This sensor, which acts as a receiver for remote control, adjusts the lamp intensity by varying the signal to the error feedback network 203. Thus, the digital interface 201 Gill provide a digital port for building power management systems using a digital port external computer or similar device to control the intensity of the lamp. The photo detector or sensor circuitry of the interface 201 senses external lighting conditions and adjusts the intensity to a particularly precalibrated value.

A square wave generated by transistors Q2 and Q3 is applied to four independent resonant circuits, such as inductor L2 and capacitor C1, inductor L3 and capacitor C2, inductor L4 and capacitor C3, and inductor L5 and capacitor C4. Transformer T1 is connected to square wave generator to provide step-down voltage to the filaments of the lamps LP1, LP2, LP3 and LP4. Capacitor C5 helps to block DC current being injected to the lamps. Since individual loads are connected to each of the multiple independent resonant circuits, the inverter circuitry forms a parallel connected electronic ballast. This arrangement makes each lamp work independently and provides fault tolerance and universal operation for 4, 3, 2 or 1 lamp applications.

Figure 3:
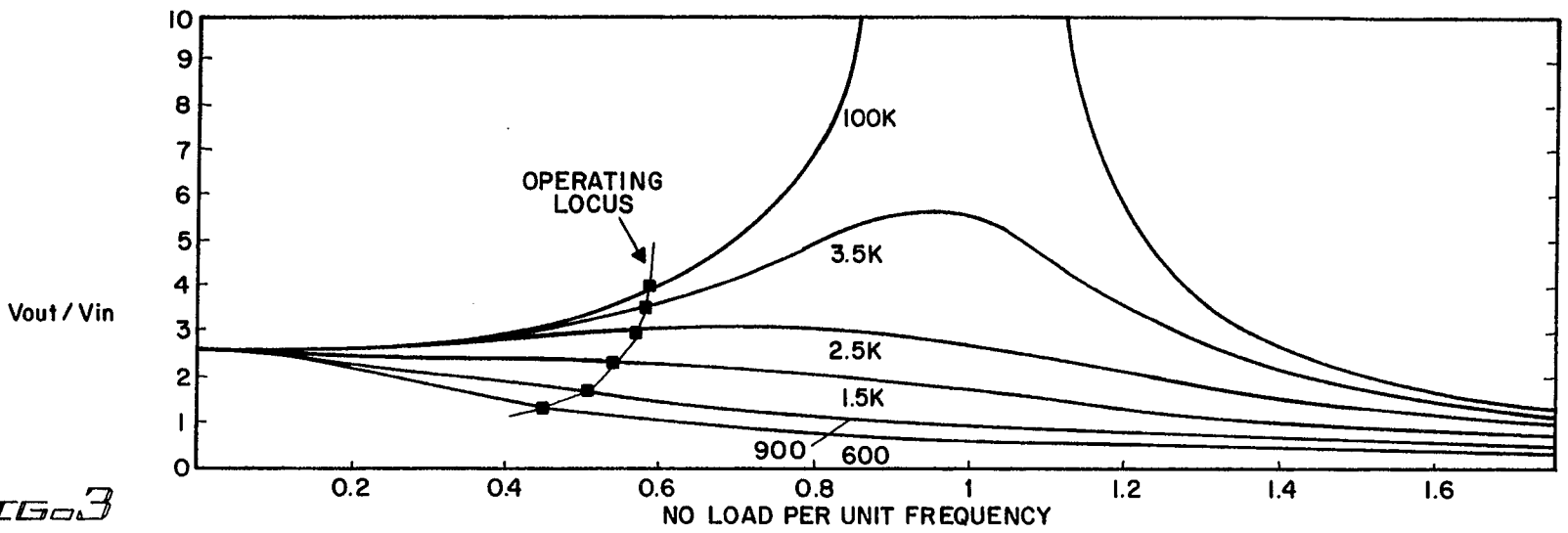
FIG. 3 is a chart plotting operating frequency against gain of the resonant circuits as utilized in the present invention.

For analysis of the operation of the above-described circuitry, reference is made first to FIG. 3 which shows results obtained from fundamental analysis.

In fundamental analysis we assume that the inverter output is sinusoidal and continuous, meaning that the fundamental frequency of the inverter and switching frequency is one and the same. By this assumption and using L and C as resonant elements, we can deduce that $$\frac{V_o}{V_s} = \frac{\frac{4}{\pi}}{\sqrt{(1 - w^2)^2 + \left(\frac{Z_o}{R_f}\right)^2 (w_n)^2}}$$

where $$w_n = \frac{f_{switching}}{f_{resonance}}$$

is the per unit frequency $$Z_o = \sqrt{\frac{L}{C}}$$

Land C are resonant elements and computation of $Z_o$ can be done by using $$Z_o = \frac{R_f\sqrt{\left(\frac{4V_s}{\pi V_{load}}\right)^2 - (1 - w_n)^2}}{w_n}$$

Figure 5:
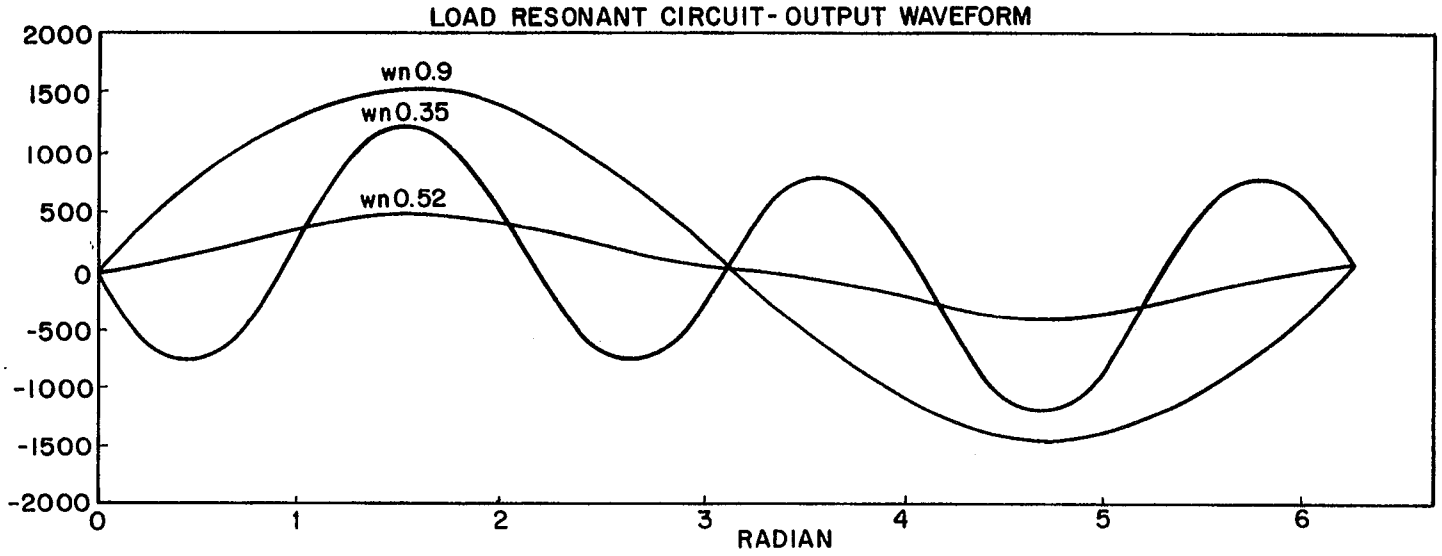
FIG. 5 shows the wave form of the inverter if the circuit is operated in different regions below the natural resonant frequency.

This relates output voltage to two parameters $f_{switching}$ and $v_s$ which is the input DC voltage, the plot on FIG. 3 shows dependence of load resistance on output voltage and its control achieved by the switching frequency. When approaching lower per unit frequency, the wave form approaches discontinuous mode as displayed in FIG. 5, at resonance or close to resonance this is nearly sinusoidal, and distorts when operating at nearly twice the frequency as it approaches 0.3 per unit frequency, where per unit frequency $w_n$ is the ratio of switching and natural resonant frequency.

Figure 4:
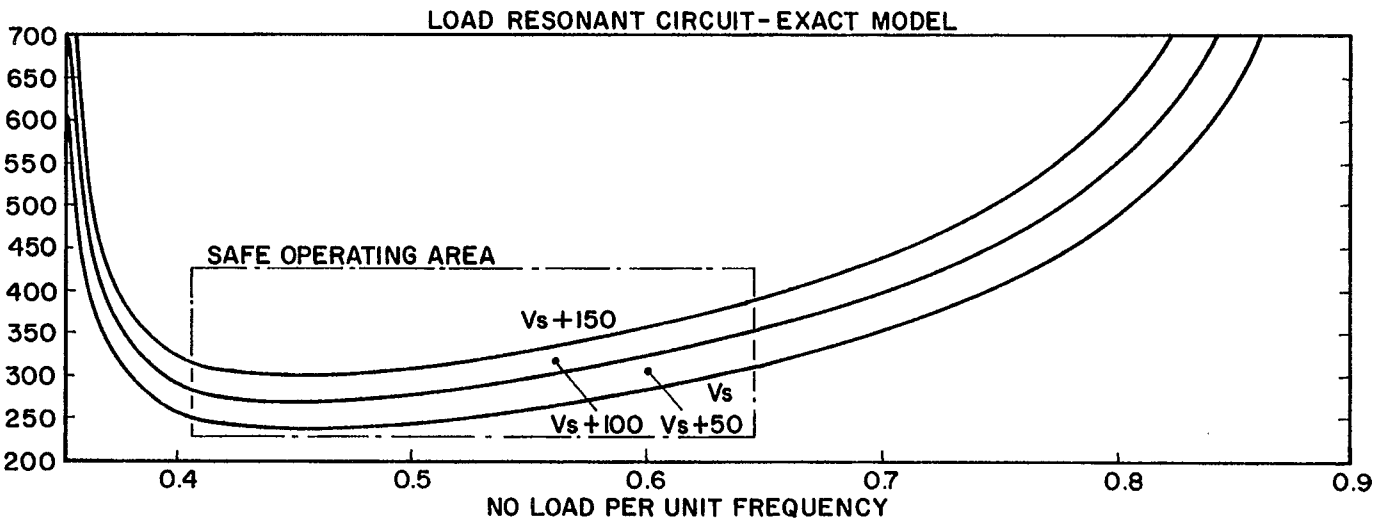
FIG. 4 shows gain as calculated when various values are plotted with different values of power supply voltage to exhibit linear operation in a no-load mode.

To be accurate, the RMS value of the no load voltage has to be computed by accommodating waveform distortion. This is illustrated by FIG. 4 for different value of the PFC voltage, as we can see that the no-load voltage sharply rises to a very high value if we operate below $w_n<0.4$. The three set of curves for different value of DC voltage show that this operation is stable even if we vary the input voltage.

Figure 6:
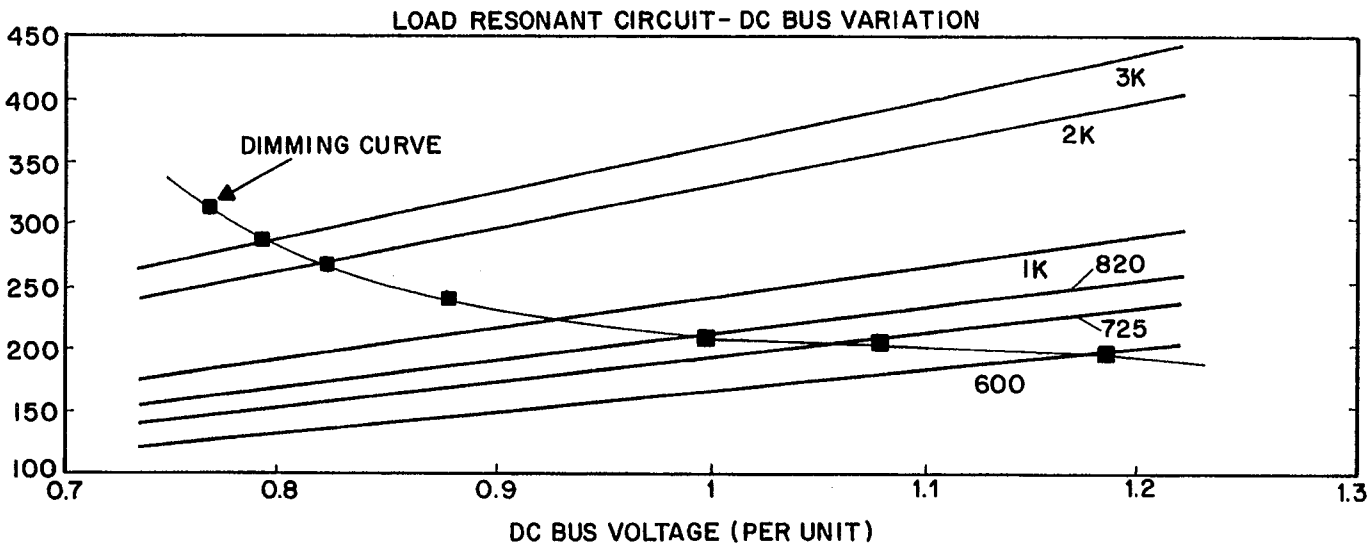
FIG. 6 shows the flexibility of dimming operation by controlling only the DC voltage with a constant frequency.

To see the variation in output load voltage as the DC bus is changed, refer to FIG. 6. A fluorescent lamp with its negative resistive characteristic takes less current as we increase the voltage. Power consumed by the lamps depends on the voltage across the lamp. FIG. 6 shows plots of load power variations as the input DC voltage is changed. Different values of resistors represent different power levels in a dimming ballast.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. An electronic ballast circuit for operation of a plurality of fluorescent lamps comprising:
   rectifier means connected to a source of alternating current, operated to produce direct current;
   a voltage boost converter connected to the output of said rectifier operated to provide a regulated voltage to an inverter circuit;
   said inverter circuit operated to generate a square wave output to a plurality of resonant circuits through direct connection or by means of transformer isolation;
   each of said resonant circuits connected to a fluorescent lamp to provide operating power to the connected lamp;
   and a control circuit connected to the output of said rectifier and said boost converter, said control circuit operated in response to said converter and an error circuit including a driver having a pair of output circuit connections to said inverter further including an input connected to each of said resonant circuits, to control the amount of voltage to said inverter and to control the frequency of operation of said inverter.

2. An electronic ballast as claimed in claim 1 wherein:
   said resonant circuits each include a capacitor and an inductor, each inductor including a circuit connection to said error circuit included in said controller.

3. An electronic ballast as claimed in claim 1 wherein:
   said input circuits from said resonant circuits to said error circuit each include rectifying means;
   and said inputs are filtered by means of a capacitor, 4. An electronic ballast as claimed in claim 1 wherein:
   said control circuit further includes a pair of drivers connected to said inverter circuit;
   an oscillator circuit operated to alternately operate said drivers to control switching devices in said inverter on a push-pull basis;
   and said drivers each further including a circuit connection to said error circuit connected to said resonant circuits.

5. An electronic ballast as claimed in claim 1 wherein:
   said error circuit further includes a connection to a no-load timer operated to provide periodic control of said driver circuit in response to a lack of fluorescent lamps connected to each of said resonant circuits.

6. An electronic ballast as claimed in claim 1 wherein:
   said control circuit includes a power factor controller including circuit connections from the output of said bridge rectifier, from said boost converter and feedback from said boost converter and also from a feedback network.

7. An electronic ballast as claimed in claim 6 wherein:
   said feedback network includes inputs from said bridge and feedback from said boost converter.

8. An electronic ballast as claimed in claim 6 wherein:
   said feedback network includes additional circuit connections from sensor circuitry operated to detect variations in ambient lighting conditions in an area where said fluorescent lamps are located.

9. An electronic ballast as claimed in claim 6 wherein:
   said feedback network further includes a circuit connection from a manual control means operated to establish a predetermined voltage level for operation of said fluorescent lamps.

10. An electronic ballast as claimed in claim 8 Wherein:
   there is further included remote control means operated to control said sensor circuitry to operate said feedback network.

11. An electronic ballast as claimed in claim 6 wherein:
   said feedback network further includes an output circuit connected to said oscillator operated to determine the frequency of operation of said driver circuitry thus controlling the frequency of operation of said inverter circuit.

* * * * *